United States Patent [19]

Takada et al.

[11] Patent Number: 4,795,294

[45] Date of Patent: Jan. 3, 1989

[54] FIXING DEVICE FOR BRITTLE BOARD SUCH AS PLASTERBOARD

[75] Inventors: Tetsuo Takada, Kosugimachi; Mikio Kita, Tokyo; Kenzo Yonemochi, Nagareyama, all of Japan

[73] Assignee: Nippon Light Metal Co., Ltd., Tokyo, Japan

[21] Appl. No.: 918,089

[22] Filed: Oct. 14, 1986

[30] Foreign Application Priority Data

Oct. 14, 1985 [JP] Japan ..... 60-156796

[51] Int. Cl.[4] ..... F16B 15/00

[52] U.S. Cl. ..... 411/457; 411/439; 411/458; 411/469; 411/922; 248/493; 248/547

[58] Field of Search ..... 411/457, 458, 439, 469, 411/470, 922; 248/224.4, 225.1, 493, 547

[56] References Cited

U.S. PATENT DOCUMENTS

| | | | |
|---|---|---|---|
| 388,063 | 8/1888 | Moody | 411/922 X |
| 1,998,610 | 4/1935 | Ellis | 411/457 X |
| 2,226,168 | 12/1940 | Kass | 248/547 |
| 2,238,238 | 4/1941 | Westrobe | 411/457 X |
| 2,288,439 | 6/1942 | Dahm | 248/547 |
| 2,497,615 | 2/1950 | Lux | 248/493 |
| 2,940,712 | 6/1960 | Lloyd-Young | 411/477 X |
| 3,599,686 | 8/1971 | Peebles | 248/547 X |
| 3,955,462 | 5/1976 | Thorsman | 411/439 |
| 4,026,510 | 5/1977 | Holmes | 248/493 |
| 4,094,490 | 6/1978 | Einhorn | 248/547 X |
| 4,525,115 | 6/1985 | Garner, Sr. | 411/457 |
| 4,655,423 | 4/1987 | Schavilje et al. | 248/547 X |
| 4,708,552 | 11/1987 | Bustos et al. | 411/60 |

FOREIGN PATENT DOCUMENTS

| | | | |
|---|---|---|---|
| 284240 | 11/1913 | Fed. Rep. of Germany | 411/439 |
| 50460 | 3/1932 | Fed. Rep. of Germany | 411/439 |
| 530942 | 10/1921 | France | 411/457 |
| 1520720 | 3/1968 | France | 248/225.4 |
| 1829 | of 1894 | United Kingdom | 411/439 |
| 21737 | of 1898 | United Kingdom | 411/458 |

*Primary Examiner*—Neill Wilson
*Assistant Examiner*—Suzanne L. Dino
*Attorney, Agent, or Firm*—Oblon, Fisher, Spivak, McClelland & Maier

[57] ABSTRACT

The fixing device comprises a body adapted to be secured directly onto a brittle wall or secured to the brittle wall with a member to be attached to the wall interposed therebetween. The body is formed with at least two guide holes passing therethrough from the top to the bottom thereof each for receiving therein a fixing member such as a set screw or a nail so that it is driven into the wall to thereby fixedly secure the body onto the wall. The guide holes are oriented in such an inclinded direction with respect to the normal to the wall that the fixing members do not intersect with each other and do not extend in parallel to each other when they are inserted into the body and driven into the wall, thereby permitting the body to be securely fixed to the wall. An engaging member having integrally formed therewith a supportng portion such as a hook or a hanger may be detachably engaged over the body. Alternatively, the body itself may be integrally formed with a supporting portion such as a hook, a hanger and a ring.

15 Claims, 14 Drawing Sheets

FIXING DEVICE FOR BRITTLE BOARD SUCH AS PLASTERBOARD

FIELD OF THE INVENTION

The present invention relates to a fixing device for use with a wall or a ceiling made of a brittle board such as a plasterboard, a refractory board and a veneer plywood. More particularly, the present invention relates to a fixing device for securing an article such as a shelf, a cooler and an illuminating device to the surface of a brittle wall or securing a bracket for mounting thereon the article to the surface of the brittle wall, the fixing device being able to be easily secured to the wall by using fixing members such as nails and set screws, wherein no serious defective holes or flaws are left in the wall after the fixing device is detached from the wall.

The present invention further relates to a fixing device which can be attached to the brittle wall and serves as supporting means such as a hook and a hanger.

BACKGROUND OF THE INVENTION

Since the plasterboard, the refractory board and the veneer plywood are very brittle, the fastening force for holding the nails or the set screws driven into such a brittle plasterboard is very low and unstable, so that the nails or the set screws thus secured to the brittle wall tend to be loosened or detached when a load or a vibration is applied thereto. Therefore, such nails and set screws are not suitable for positively securing the fixing device to the brittle wall.

It has been proposed heretofore as shown in FIG. 47 to use a backplate 1 made of wood, for example, which is attached to the rear surface of the brittle plasterboard or the refractory board 2 at a predetermined position when nails or screws are used for securing the fixing device onto that portion of the board where the backplate is attached. Thus, the effective holding force is obtained when the article 3 shown as a hook is to be attached onto the board 2 by using the nails or the set screws 4 by virtue of the fact that the nails or the set screws 4 are driven into the backplate 1 having a sufficient holding force.

As an alternative measure for securing the fixing device onto the brittle plasterboard, it has been known to use an anchor bolt in place of the set screws and the nails. As an example of using the anchor bolt as shown in FIG. 48, an anchor member 6 is threadedly fitted on the bolt 5 as shown by the one dot chain line and the anchor member 6 is inserted into the holes 3*a* and 2*a* formed in the article 3 and the plasterboard 2 together with the bolt 5, respectively, so as to extend outwardly from the rear side of the board 2 and, thereafter, the bolt 5 is rotated relative to the anchor member 6 so that the portion of the anchor member 6 extending outwardly from the rear surface of the board 2 is axially compressed to expand radially as shown by the solid line thereby securing the article 3 tightly to the board 2.

FIG. 49 shows an alternative form of the anchor member. It is made of material such as a resilient plastic material and is formed with a plurality of spring-back arms 7*a* extending from the outer end of the stem 7 which is in turn integrally formed with a hook 3. The spring-back arms 7*a* are directed toward the hook 3 with radially expanding resilient force being given to the arms 7*a*, so that, after the stem 7 is inserted into the hole 2*a* of the board 2 and the arms 7*a* extend out of the rear side of the board 2, the arms 7*a* expand radially by their resilient forces and abut against the rear side of the board 2 to thereby secure the hook 3 to the board 2.

In such a prior art fixing device as shown in FIG. 47, however, a backplate 1 must be provided prior to the securing of the fixing device, thereby raising the cost, and, at the same time, the position of the board 2 to which the article 3 is to be secured is limited.

In the methods using an anchor bolt and an anchor member as shown in FIGS. 48 and 49, a relatively large hole 2*a* must be formed in the board 2, thereby requiring a tool such as a drill, and a sufficient space must be provided at the rear side of the board 2, and an undesired play tends to occur in the hole 2*a*. Further, a large hole 2*a* is left after the anchor bolt 5 is removed together with the anchor member 6 shown in FIG. 48, while the anchor member having the stem 7 and the spring-back arms 7*a* shown in FIG. 49 cannot be removed once it is secured to the board 2.

In the prior art fixing device using set screws or nails, attention is required for the operator as to in which direction they are to be driven so as to achieve a strong securing force, or relatively large set screws or nails must be used to obtain sufficient securing force. The set screws and the nails tend to be loosened and detached from the brittle board in a relatively short time, and a large hole or flaw is left in the board after the fixing device is removed, thereby deteriorating the appearance of the board.

OBJECT OF THE INVENTION

It is, therefore, an object of the present invention to provide a fixing device which can be easily and detachably secured firmly to a brittle wall such as that made of a plasterboard or a refractory board by using set screws or nails and yet no defective holes or flaws are left in the wall after the fixing device is removed from the wall.

SUMMARY OF THE INVENTION

To achieve the above object, the present invention is characterized by the provision of a fixing device comprising a body adapted to be secured directly onto a brittle wall portion or secured to the brittle wall portion with a member to be attached to the wall portion interposed between the body and the wall portion. The body is formed with at least two guide holes passing therethrough from the top to the bottom thereof, each for receiving therein a fixing member such as a set screw or a nail so that it is extended into the wall portion to thereby fixedly secure the body to the wall portion. Each of the guide holes is oriented in such an inclined direction with respect to the normal to the wall portion that the fixing members do not intersect with each other and do not extend in parallel to each other when they are inserted into the guide holes and extended into the wall portion, thereby permitting the body to be securely fixed to the brittle wall portion.

In the construction of the fixing device described above, it is preferred to construct the fixing device in such a manner that the body is in a cylindrical shape and a plurality of guide holes are formed in the body. The guide holes are arranged at substantially equal angular distance from each other around the central axis of the body. The opening of each of the guide holes at the top of the body is located at a position remote from the central axis, while the opening at the bottom thereof is located at a position adjacent to the central axis but does not intersect with the central axis. The opening at the top and the opening at the bottom of each guide hole is angularly shifted relative to each other around the central axis so that the fixing members inserted into the guide holes and extended into the wall portion do not intersect with each other and do not extend in parallel to each other, thereby insuring that the body can be fixedly secured to the wall portion by virtue of the fact that the fixing members driven into the brittle wall portion do not extend in parallel to each other but all of the fixing members extend in different directions from each other.

According to another characteristic feature of the present invention, there is provided a fixing device comprising a body adapted to be secured directly onto a brittle wall portion or secured to the brittle wall portion with a member to be attached to the wall portion interposed between the body and the wall portion. The body is formed with at least two guide holes passing therethrough from the top to the bottom thereof each for receiving therein a fixing member such as a set screw or a nail so that it is extended into the wall portion to thereby fixedly secure the body to the wall portion. Each of the guide holes is oriented in such an inclined direction with respect to the normal to the wall portion that the fixing members do not intersect with each other and that some of the fixing members do not extend in parallel to the remaining fixing members. An engageable member is adapted to be detachably engaged with the body over the same, the engageable member being formed integrally with a supporting portion such as a hook and a hanger.

In the above described construction, it is preferred to construct the fixing device in such a manner that the body has a pair of parallel side edges and the guide holes are located in spaced relationship from each other along the pair of parallel side edges adjacent thereto, respectively. The positions of the guide holes along one of the pair of parallel side edges correspond to those of the guide holes along the other side edge, respectively. The guide holes located along the one side edge are oriented in parallel to each other and inclined at an angle with respect to the normal to the wall portion in parallel to the one side edge, while the guide holes located along the other side edge are oriented in parallel to each other and inclined at the above described angle with respect to the normal to the wall portion in parallel to the other side edge but in the direction opposite to the direction of inclination of the guide holes located along the one side edge. The pair of side edges are formed with engaging means such as projections and grooves, while the engageable member is formed in its inner opposing side walls with mating engaging means for slidably engaging with the engaging means formed in the side edges of the body.

In accordance with a further characteristic feature of the present invention, there is provided a fixing device comprising a body adapted to be secured directly onto a brittle wall portion or secured to the brittle wall portion with a member to be attached to the wall portion interposed between the body and the wall portion. The body is formed with at least two guide holes passing therethrough from the top to the bottom thereof each for receiving therein a fixing member such as a set screw or a nail so that it is extended into the wall portion to thereby fixedly secure the body to the wall portion. Each of the guide holes is oriented in such an inclined direction with respect to the normal to the wall portion that the fixing members do not intersect with each other and do not extend in parallel to each other when they are inserted into the guide holes and extended into the wall portion. The body is formed integrally with a supporting portion such as a hook, a hanger or a ring.

Since it is rather difficult to drive each of the fixing members into the wall portion at an angle with respect to the normal to the wall portion without causing relative shifting movement of the body with respect to the wall portion, it is proposed in accordance with the present invention to provide temporarily fixing means. Such temporarily fixing means may be in the form of a temporarily fixing pin preliminarily secured to the bottom of the body or integrally formed in the bottom of the body. Further, the temporary fixing means may be in the form of a temporarily fixing guide hole formed in the body and extending in parallel to the normal to the wall portion into which a temporarily fixing member such as a nail or a set screw is inserted and driven into the wall portion before the body is finally secured to the wall portion.

DETAILED DESCRIPTION OF THE PREFERRED EMBODIMENTS

Figure 1:
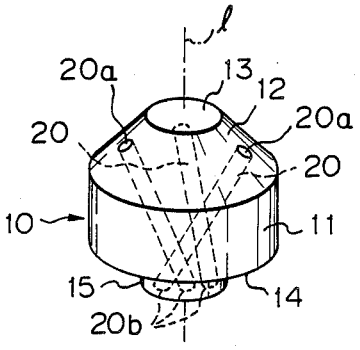
FIG. 1 is a perspective view showing an embodiment of the fixing device of the present invention.
Figure 1A:
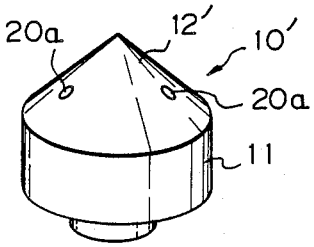
FIGS. 1A and 1B are perspective views similar to FIG. 1 but each showing alternative forms of the head portion of the body of the fixing device, respectively.
Figure 1B:
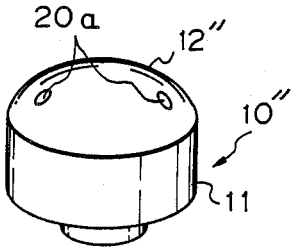

FIG. 1 shows an embodiment of a body 10 of the fixing device constructed according to the present invention. The body 10 comprises a body member 11 having a circular cross-section, the head of which is frustconical, the imaginary apex of which lies on the central axis of the body member 11. The conical surface 12 and the top surface 13 form the head of the body member 11. The bottom 14 is flat, but a cylindrical projection 15 is formed at the center thereof so that the bottom 14 is made in a stepped configuration. It is also possible to construct the head of the body 10′ by a conical surface 12′ as shown in FIG. 1A or to construct the body 10″ by a part-spherical surface 12″ as shown in FIG. 1B.

The body may be made of a rigid plastic material such as an ABS resin or a metal such as copper, aluminum, or zinc.

Figure 2:
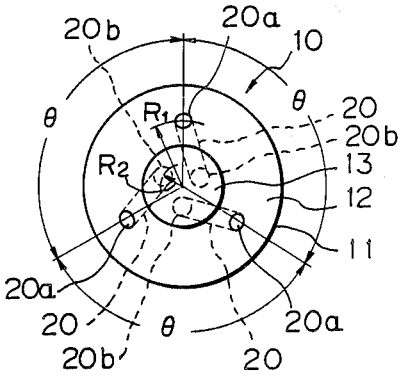
FIG. 2 is a top plan view of the body shown in FIG. 1.

The body 10 is formed with a plurality of guide holes 20 (three guide holes 20 being shown in FIG. 1) passing therethrough from the conical surface 12 to the bottom 14 (in FIG. 1, to the bottom surface of the projection 15). The guide holes 20 can have smooth inner walls (as shown at the left in FIG. 1) to accept nails or they can have threaded portions (as shown at the right in FIG. 1) to threadedly engage with a thread formed on a set screw adaptable to be inserted therein. The distance $R_1$ (FIG. 2) between the position of the opening 20*a* of each guide hole 20 opening in the conical surface 12 and the central axis l is made greater than the distance $R_2$ (FIG. 2) between the opening 20*b* of the same guide hole 20 and the central axis l. The openings 20*b* are preferably located adjacent to the central axis l. As shown in FIG. 2, the openings 20*a* of the guide holes 20 are positioned in angularly equally spaced relationship from each other around the central axis by an angle $\theta$ (in FIG. 2, the angle $\theta=120°$), and the openings 20*b* are also angularly equally spaced form each other by the angle $\theta$ (in FIG. 2, the angle $\theta=120°$), but the opening 20*b* of each guide hole 20 is angularly shifted around the central axis l with respect to the opening 20*a* of the same guide hole 20 so that each guide hole 20 extends from the opening 20*a* to the opening 20*b* toward the central axis l but does not intersect with the central axis l nor with each other and none of the guide holes 20 extends in parallel to each other. Thus, the guide holes 20 are oriented in angular or rotational symmetry with respect to the central axis l, each guide hole 20 being arranged in swivelling relationship around the central axis l. Put otherwise, the guide holes 20 are oriented in equiangular spaced relationship around the central axis l and in angular symmetry with respect to the central axis l.

Figure 3:
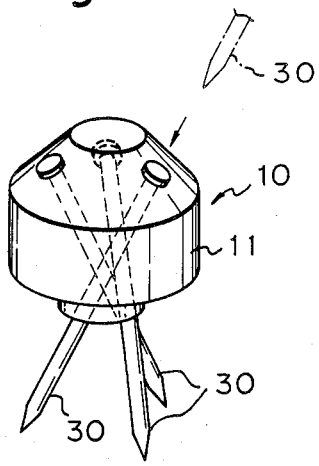
FIG. 3 is a perspective view showing the state of the body shown in FIG. 1 to which nails are inserted into guide holes formed in the body.
Figure 4:
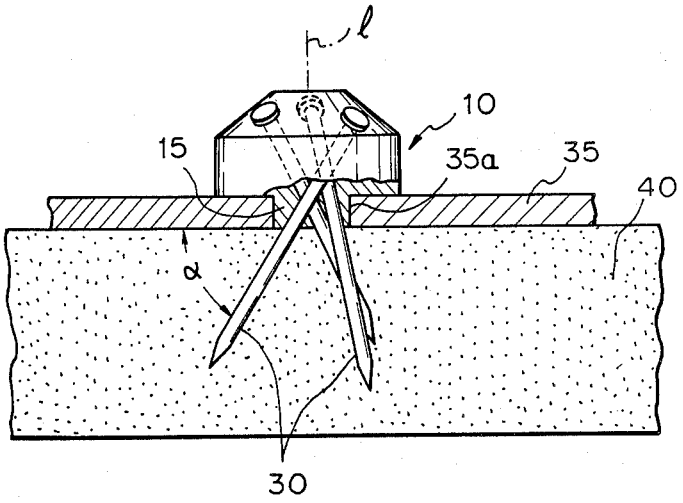
FIG. 4 is a side view partly in cross-section showing the state of an article secured to the wall portion by using the body of the fixing device shown in FIG. 1.

As shown in FIG. 3, the body 10 is secured to a wall (not shown) by inserting into the respective guide holes 20 nails 30 or set screws and driving them along the guide holes 20 into the wall portion. As shown in FIG. 4, for example, a plate-like article 35 can be secured to a plasterboard 40 by using the body 10 and the nails 30, with the projection 15 being fitted into a mounting hole 35*a* formed in the plate-like article 35 and the body 10 being mounted on the plasterboard 40 in position with the article 35 being interposed therebetween, after which the nails 30 are inserted into the guide holes 20 in the body 10 and driven along the guide holes 20 into the plasterboard 40. By virtue of the orientation of the guide holes 20 in the body 10, the free end of each nail 30 extends radially outwardly from the central axis l, and none of the nails 30 extends in parallel to any other one of the nails 30, thereby insuring firm attachment of the body 10 to the plasterboard 40 with the plate-like article 35 being firmly mounted on the plasterboard 40. The angle $\alpha$ of the direction of driving of the nails 30 is preferably set to about 60° i.e., about 30° with respect to the normal to the plane of the plasterboard 40 as shown in FIG. 4. However, the angle $\alpha$ may be set to any appropriate angle depending upon the number of nails 30 used to secure the body 10.

It is evident that set screws may be used in place of the nails 30 for securing the body 10 to the plasterboard 40. Further, it is also possible to preliminarily form a screw thread in the inner surface of each guide hole 20 for facilitating the driving of the corresponding set screw.

Figure 5:
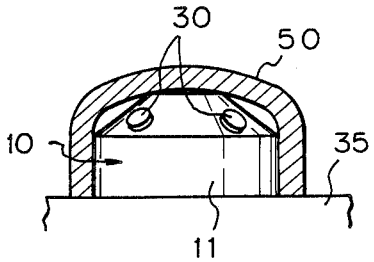
FIGS. 5 and 6 are side views partly in cross-section each showing a cap secured onto the body of the fixing device.

In the body which can be secured to the wall by the nails 30 or the set screws as described above, the head of each nail 30 and the like is exposed to the exterior. Therefore, in consideration of the good appearance, it is preferred to mount a cap 50 made of a soft plastic material such as polyethylene on body 10 as shown in FIG. 5. In FIG. 5, the cap 50 is simply applied onto the body 10. In this case, it is preferable to provide a taper so that the outer diameter of the body 10 is enlarged toward the bottom thereof in order to facilitate the attachment of the cap 50 onto the body 10. It is of course possible to use a bonding agent to secure the cap 50 to the body 10.

Figure 6:
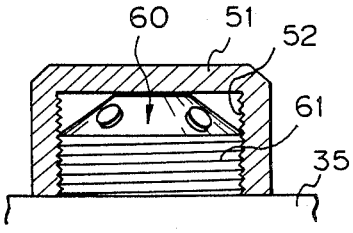

FIG. 6 shows another method of attaching the cap to the body. In this case, a threaded portion 61 is formed on the outer peripheral surface of a body 60 (similar to the body 10), and a cap 51 made of a hard plastic material or a metal is formed in its inner peripheral surface with a mating threaded portion 52 engaging with the threaded portion 61, thereby permitting the cap 51 to be threadedly secured to the body 60.

Figure 7:
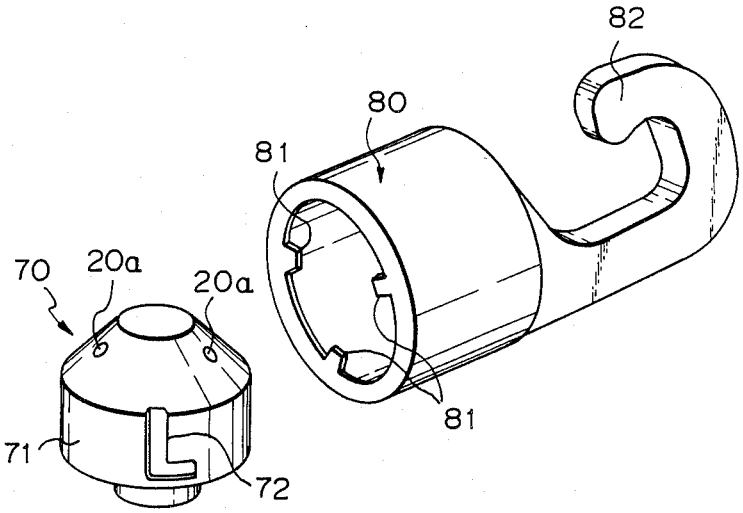
FIG. 7 is an exploded perspective view showing an embodiment of the fixing device wherein a hook is integrally formed in the cap.

FIG. 7 shows a further method of mounting the cap on the body. In this case, a plurality of L-shaped engaging grooves 72 (one of three L-shaped engaging grooves 72 being shown in the figure) are formed in the outer peripheral surface of a body 71 of a fixing device 70, while mating projections 81 are formed in the inner peripheral surface of a cap 80, each of the mating projections 81 engaging with a corresponding L-shaped groove 72. Thus, the cap 80 can be mounted on the body 71 by fitting the cap 80 on the body 71 with the L-shaped grooves 72 being engaged with the projections 81 and rotating the cap 80 relative to the body 71 so as to engage each of the projections 81 with the arm portion of the corresponding L-shaped groove 72 extending circumferentially of the body 71 so that the cap 80 is prevented from being removed from the body 71.

Since the firm attachment of the cap 80 to the body 71 is insured by virtue of the provision of the L-shaped grooves 72 and the mating projections 81, a supporting portion such as a hook 82 may be integrally formed in the cap 80 in order to utilize the cap 80 as a supporting member. In this case, the fixing device 70 is directly attached to the plasterboard 40 with appropriate angular orientation, and the cap 80 is engaged with the body 71 so that the hook 82 can be used for the supporting purpose. The hook 82 may be substituted by any desired configuration depending upon the purpose of use.

It is of course possible to provide a supporting portion such as the hook 82 in the cap shown in FIG. 5 using the bonding agent or in FIG. 6 using the threaded portion formed therein.

Figure 8:
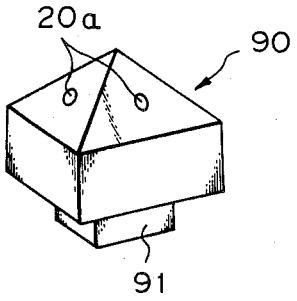
FIG. 8 is a perspective view showing an embodiment of the body of the fixing device of the present invention having the rectangular form in cross-section.

In foregoing description, the embodiments of the fixing devices each having a body in a cylindrical shape in cross-section have been described. It is of course possible to construct a fixing device having a body having a cross-sectional configuration other than a cylindrical shape. For example, the fixing device 90 may have a body of a square shape in cross-section as shown in FIG. 8. A body of any rectangular shape in cross section may be used. A projection 91 (in FIG. 8) may also be in a square shape in cross-section.

Figure 9:
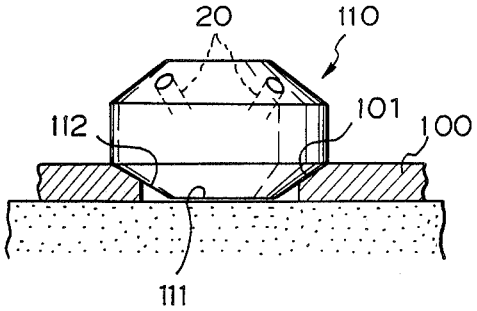
FIG. 9 is a side view partly in cross-section showing an embodiment of the body having a further alternative form.

FIG. 9 shows a fixing device having a body 110 having a frustoconical surface 112 around a bottom surface 111 adapted to snugly engage with a countersink 101 formed in an article 100 to be attached to the wall by means of the fixing device. The body 110 is formed with a plurality of guide holes 20 in like manner as the previously described embodiments.

In using the fixing device shown in FIG. 9, nails or set screws are inserted into the guide holes 20 and driven into the wall to which the body 110 is to be secured along the guide holes 20 after the body 110 is positioned on the wall in position with the frustoconical surface 112 of the body 110 being snugly fitted in the countersink 101 of the article 100 interposed between the body 110 and the wall.

Figure 10:
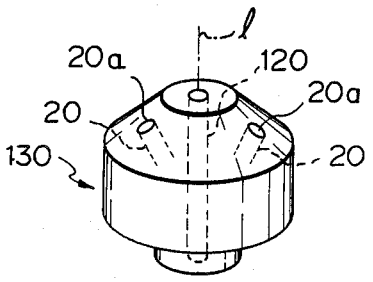
FIG. 10 is a perspective view showing an embodiment of the body provided with a temporarily fixing guide hole.

FIG. 10 shows a fixing device having a body 130 provided with a guide hole 120 for guiding a temporarily fixing nail or set screw adapted to be preliminarily driven into the wall prior to the securing of the body 130 to the wall in order to positively prevent the undesired relative shifting of the body 130 with respect to the wall when the fixing members such as nails and set screws are inserted into the guide holes 20 and driven into the wall along the guide holes 20.

Figure 11:
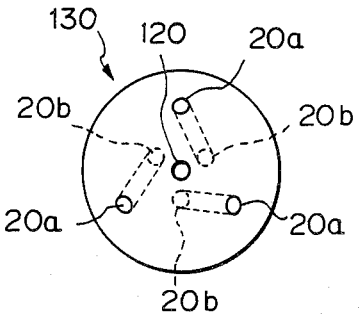
FIG. 11 is a top plan view of FIG. 10.

As shown in FIG. 10, the temporarily fixing guide hole 120 extends along the central axis l of the body 130 for guiding a temporarily fixing nail or set screw in the direction perpendicular to the wall, thereby preventing the relative shifting of the body 130 relative to the wall when the temporarily fixing nail or set screw is driven into the wall. As shown in FIG. 11, the guide hole 120 does not intersect with any of the guide holes 20.

It is of course possible to position the temporarily fixing guide hole 120 at any position spaced apart from the central axis l so long as it does not intersect with the guide holes 20 but extends in the direction perpendicular to plane of the wall. Any number of the temporarily fixing guide holes 120 other than one may also be used.

Figure 12:
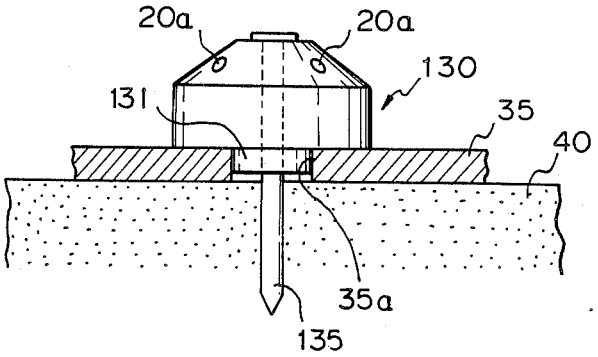
FIG. 12 is a side view partly in cross-section showing the state of the body shown in FIG. 11 wherein the body is temporarily secured to the wall portion by using a temporarily fixing nail.

As shown in FIG. 12, the body 130 may be used to secure an article 35 to the plasterboard 40 in like manner as in the case of FIG. 4. In the case shown in FIG. 12, a projection 131 is fitted in the mounting hole 35*a* formed in the article 35, and the body 130 is located in position on the plasterboard 40 with the article 35 interposed therebetween. The temporarily fixing member 135 is then inserted into the guide hole 120 and driven along the guide hole 120 into the plasterboard 40 so as to temporarily secure the body 130 and the article 35 onto the plasterboard 40. Thereafter, the nails or the set screws are inserted into the guide holes 20 and driven therealong into the plasterboard 40 to finally secure the body 130 and the article 35 to the plasterboard 40. A cap may also be applied optionally on the body 130.

Figure 13:
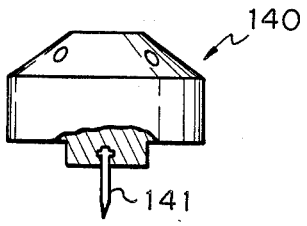
FIGS. 13 and 14 are side views showing an embodiment of the body in which a temporarily fixing member is integrally formed.

FIG. 13 shows an alternative form of the temporarily fixing means. As shown in FIG. 13, a temporarily fixing member such as a pin 141 is embedded in the bottom of a body 140 of the fixing device. In FIG. 13, the temporarily fixing member is located along the central axis l, but it may be positioned at any position apart from the central axis l. Any number of temporarily fixing members other than one may also be provided. The fixing device shown in FIG. 13 is advantageously when the fixing device made of a plastic material.

Figure 14:
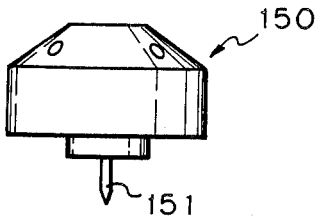

FIG. 14 shows a fixing device having a body 150 which has a temporarily fixing projection 151 integrally formed therewith. This construction of the fixing device is advantageous when the fixing device is made of a metallic material.

As described above, fixing operation is made simple, and accurate positioning of the body is achieved by virtue of the provision of the temporarily fixing member.

Figure 15:
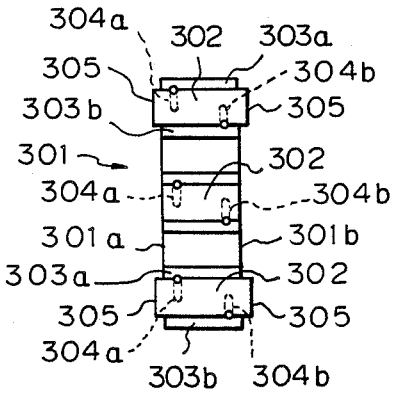
FIG. 15 is a front view showing another embodiment of the body of the fixing device of the present invention.
Figure 16:
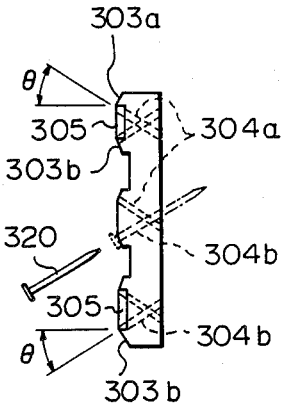
FIG. 16 is a side view of FIG. 15.
Figure 17:
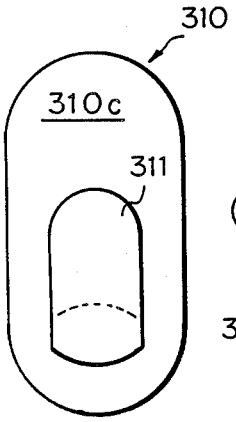
FIG. 17 is a front view showing the engageable member adapted to be engaged with the body shown in FIG. 15.

FIGS. 15 and 16 show another embodiment of the fixing device of the present invention. A body 301 of a fixing device shown in FIGS. 15 and 16 is used together with an engageable member 310 shown in FIGS. 17–20 so as to serve as supporting means such as a hook for hanging a hat or a framed picture on the vertical wall. The body 301 is generally in a rectangular parallelepipedic form having a certain thickness. Three projecting portions 302, 302, 302 are provided on the upper surface of the body 301 located at both the longitudinal end portions and at the center of the body 301, each extending laterally of the length of the body 301. Each projecting portion 302 has bevelled surfaces 303*a*, 303*b* along both the longitudinal edges. Further, the projecting portion 302 located at each end of the body 301 is formed with wing portions 305, 305 projecting from both the longitudinal ends thereof in the direction laterally of the length of the body 301. Three pairs of guide holes, each pair consisting of guide holes 304*a*, 304*b* are formed in corresponding projecting portions 302 with one of the guide holes 304*a* in each pair of guide holes 304*a*, 304*b* portion 302 extending from a position in or adjacent to the upper edge of the bevelled surface 303*a* adjacent to a longitudinal side surface 301*a* of the body 301 to the bottom surface thereof in parallel to the side surface in inclined direction at an angle $\theta$ with respect to the normal to the bottom surface as shown in FIGS. 15 and 16. The guide hole 304*b* in each pair of guide holes 304*a*, 304*b* is formed in the corresponding projecting portion 302 extending from a position in or adjacent to the upper edge of the bevelled surface 303*b* adjacent to the other longitudinal side surface 301*b* of the body 301 to the bottom surface thereof in parallel to the side surface 301*b* in inclined direction at the angle $\theta$ with respect to the normal to the bottom surface but in the direction opposite to the direction of inclination of the guide hole 304*a*. The angle $\theta$ is preferably about 30°. As shown in FIG. 16, the projection of the guide holes 304*a* 304*b* in each pair onto the plane parallel to the side surfaces 301*a*, 301*b* preferably intersects each other at a position adjacent to the bottom surface of the body 301. The body 301 is preferably made of a synthetic resin material such as ABS resin. The body 301 may also be made of a metallic material such as aluminum alloy. In an example of the body 301, it has a length of 42 mm, a width of 15.5 mm, and a thickness of 7 mm.

The engageable member 310 has a surface plate portion 310*c* and a pair of opposing arcuate peripheral walls 310*a*, 310*a* and a pair of straight peripheral walls 310*b*, 310*b* each joining the ends of the arcuate peripheral walls 310*a*, 301*a* the peripheral walls 310*a*, 310*a*, 310*b*, 310*b* extending rearwardly from the peripheral edge of the surface plate portion 310*c* to define an inner space behind the surface plate portion 310*c*. A hook 311 is integrally formed in the surface plate portion 310*c*.

Figure 19:
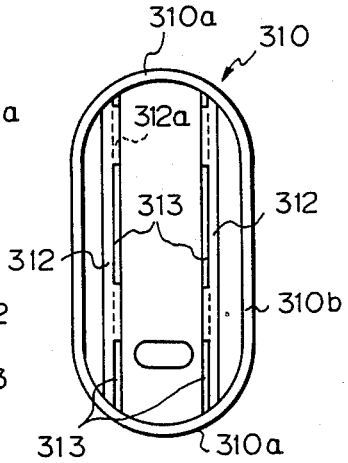
FIG. 19 is a rear view showing the engageable member shown in FIG. 17.
Figure 20:
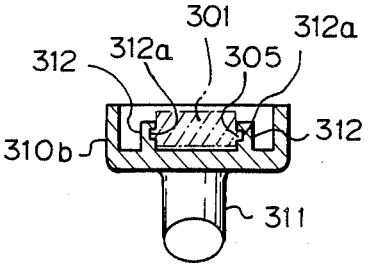
FIG. 20 is a lateral cross-sectional view of the engageable member shown in FIG. 17.

In order to detachably mount the engageable member 310 on the body 301, a pair of laterally spaced parallel longitudinal engaging walls 312, 312 are formed in the inner space behind the surface plate portion 310*c*. The opposing inner surfaces of the engaging walls 312, 312 are formed with longitudinal grooves 312*a*, 312*a* for engaging with the wing portions 305 as shown in FIGS. 18–20 and cutout portions 313,313,313,313 are formed in spaced relationship from each other as shown in FIG. 19 for permitting the wing portions 305, 305, 305, 305 of the body 301 to pass therethrough and engage with the grooves 312*a*, 312*a* by sliding the engageable member 310 relative to the body 301 in the direction shown by the arrow in FIG. 18.

Figure 18:
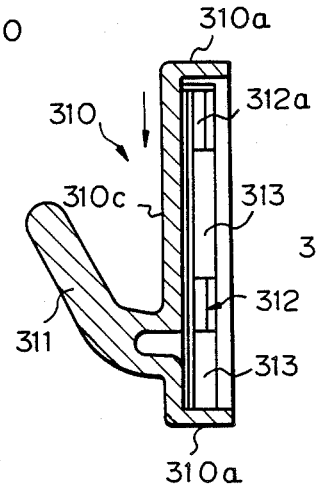
FIG. 18 is a longitudinal sectional view showing the engageable member shown in FIG. 17.

Thus, the engageable member 310 can be mounted on the body 301 by locating the engageable member 310 on the body 301 and passing the wing portions 305 through the cutout portions 313 so as to engage the same with the grooves 312*a* and sliding the engageable member 310 relative to the body 301 in the direction indicated by the arrow in FIG. 18, thereby detachably securing the engageable member 310 to the body 301 by the engagement of the wing portions 305 with the grooves 312*a*. The hook 311 serves as a hanger to support a fairly heavy article when the engageable member 310 is attached to the body 301, which is in turn secured to the vertical wall by means of fixing members such as nails 320 inserted into the guide holes 304*a*, 304*b* and driven into the wall along the guide holes 304*a*, 304*b*. The nails 320 driven into the wall in the opposite inclined directions along the guide holes 304*a*, 304*b* permit the body 301 to be firmly secured to the wall.

Since the body 301 is entirely hidden by the engageable member 310, superior appearance is insured without exposing the fixing members such as the nails 320.

When the detachment of the body 301 is desired, the engageable member 310 is first moved upwardly relative to the body 301 so as to detach the wing portions 305 from the grooves 312*a* through the cut-out portions 313, and then the nails 320 are removed from the wall. Since the diameter of each nail 320 can be quite small while still achieving a firm securing force of the body 301 to the wall, no unsightly holes are left in the wall after the nails 320 are removed.

Figure 21:
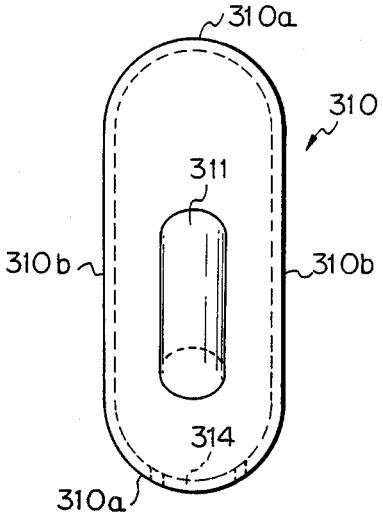
FIG. 21 is a front view showing an alternative embodiment of the engageable member of FIG. 17.

Instead of forming the cut-out portions 313 in the engaging walls 312, an opening 314 for permitting the body 301 to pass therethrough may be formed in one of the arcuate peripheral walls 310*a* as shown in FIG. 21.

Figure 22:
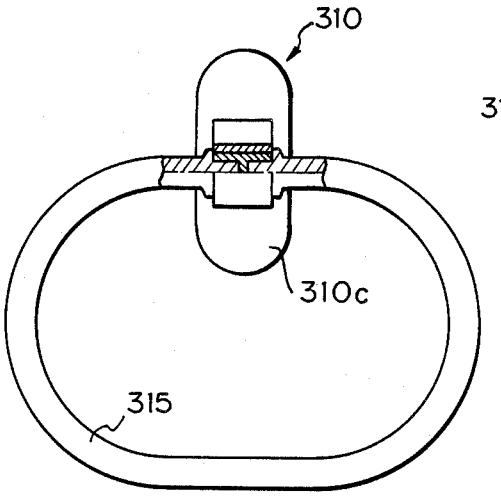
FIGS. 22 and 23 are front views showing further alternative embodiments of the engageable member of FIG. 17, respectively.
Figure 23:
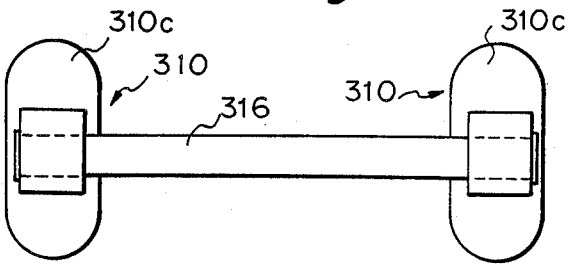
Figure 24:
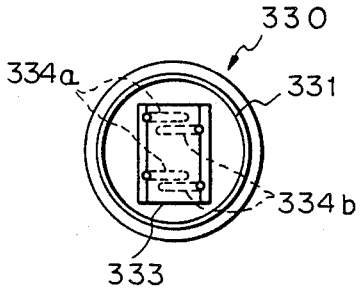
FIG. 24 is a front view showing a still further embodiment of the fixing device of the present invention.
Figure 25:
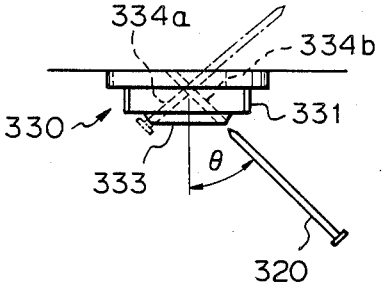
FIG. 25 is a side view of FIG. 24.
Figure 26:
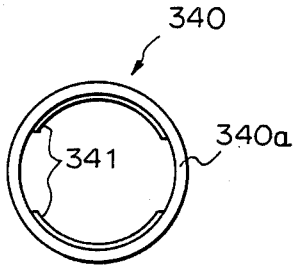
FIG. 26 is a rear plan view showing the engageable member adapted to be engaged with the body shown in FIG. 24.
Figure 27:
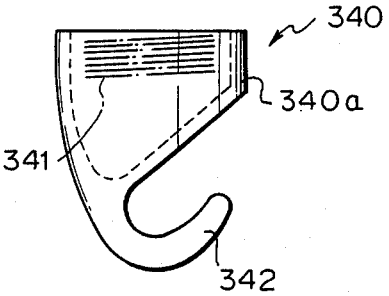
FIG. 27 is a side view of the engageable member shown in FIG. 26.

Further, instead of forming the hook 311 in the engageable member 310, a swingable ring member 315 may be mounted on the engageable member 310 as shown in FIG. 22 or a pair of engageable members 310 each engaged with the body 301 may be arranged in spaced relationship from each other and a supporting bar 316 for supporting a towel may be spanned between the pair of engageable members 310 by forming a supporting portion for supporting the end of the bar in each engageable member 310 as shown in FIG. 23.

FIGS. 24–27 show a still further embodiment of the present invention. The fixing device shown in FIGS. 24–27 is mainly adapted to be attached to the ceiling so as to hang therefrom an article. In this fixing device, a body 330 is generally in the cylindrical form, and a threaded portion 331 is formed in the outer peripheral surface. An engaging member 340 has split inner threaded portions 341 in the inner peripheral surface adapted to be engaged with the threaded portion 331. Two pairs of guide holes 334*a*, 334*b* are formed in the body 330. One guide hole 334*a* in each pair of guide holes 334*a*, 334*b* opens at its upper end in one of the upper longitudinal side surfaces of a rectangular raised portion 333 foamed on the top surface of the body 330 adjacent to the corresponding longitudinal end surface thereof and extends in an inclined direction toward the bottom of the body 330 at an angle $\theta$ with respect to the normal to the plane of the bottom in parallel to the corresponding longitudinal end surface of the raised portion 333, while the other guide hole 334*b* in each pair of guide holes 334*a*, 334*b* opens at its upper end in the other upper longitudinal side surface of the raised portion 333 adjacent to the longitudinal ends surface thereof and extends in an inclined direction toward the bottom of the body 330 at an angle $\theta$ with respect to the normal to the bottom but in the opposite direction to the inclined direction of the guide hole 334*a* of the same pair in parallel to the longitudinal surface of the raised portion 333, so that the projection of the guide holes 334*a*, 334*b* in each pair onto a plane parallel to the longitudinal end surface of the raised portion 333 intersect each other adjacent to the bottom of the body 330. The angle $\theta$ is preferably about 30°–45°.

Figure 28:
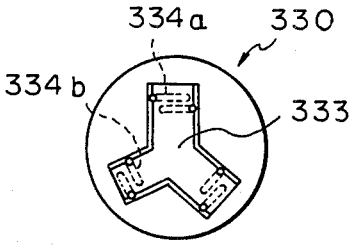
FIGS. 28 and 29 are front views showing alternative embodiments of the body shown in FIG. 24, respectively.
Figure 29:
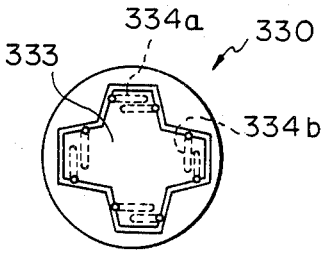

It is also possible to arrange three or more pairs of guide holes 334*a*, 334*b* located adjacent to each other in positions in the respective arms of the star-like shaped raised portion of the body 330 in rotational or angular symmetry around the central axis of the body 330 as shown in FIGS. 28 and 29.

Figure 30:
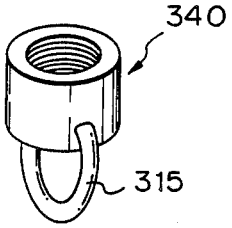
FIG. 30 is a perspective view showing an alternative embodiment of the engageable member shown in FIG. 26.
Figure 31:
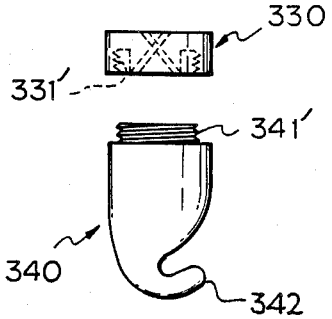
FIG. 31 is an exploded side view showing an alternative embodiment of mounting means for the body shown in FIG. 24 and the engageable member shown in FIG. 26.

Further, a hook 342 can be integrally formed in the engageable member 340 as shown in FIG. 31. However, it is also possible to provide a ring member 315 rotatably attached to the engageable member 340 as shown in FIG. 30. The configuration of the member attached to or integrally formed in the engaging member 340 may be optionally determined depending on the purpose of use. Further, it is also possible to provide an inner threaded portion 331' in the inner peripheral wall of the body 330, while a mating outer threaded portion 341' may be formed in the outer peripheral surface of the engaging member 340 adapted to engage with the inner threaded portion 331' of the body 330 as shown in FIG. 31.

Further, it is also possible in the above described embodiments that L-shaped grooves are formed in the outer peripheral surface of the body 330 while mating projections are formed in the inner peripheral surface of the engaging member 340 in like manner to that shown in FIG. 7. It is apparent that L-shaped grooves may be formed in the inner peripheral surface of the engaging member 340 while mating projections are formed in the outer peripheral surface of the body 330.

Figure 32:
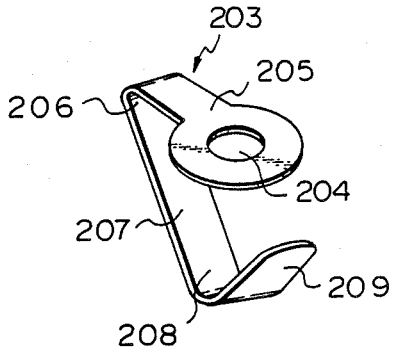
FIG. 32 is a perspective view showing a supporting member to be attached to the fixing device of the present invention.
Figure 33:
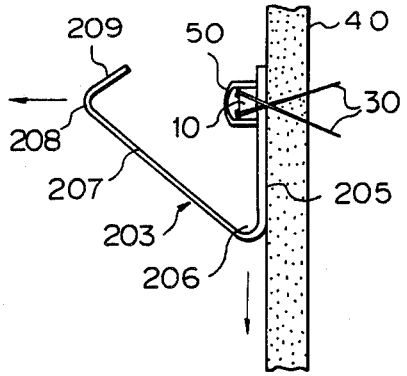
FIG. 33 is a side view partly in cross-section showing the state of the supporting member shown in FIG. 32 wherein it is secured to the wall portion by using the fixing device shown in FIG. 4.

FIG. 32 shows a supporting member 203 as an embodiment of a plate-like article 35 shown in FIG. 4 adapted to be secured to the wall by using the fixing device shown in FIG. 4. The supporting member 203 comprises a base portion 205 formed with an opening 204 for receiving the projection 15 of the body member 11 at one end, a bent-back portion 207 bent back at a bent portion 206 from the base portion 205 by an angle of about 60° and a bent tip 209 bent upwardly from the free end of the bent-back portion 207 by an angle of about 60° at a portion 208, thereby forming a supporting hook portion. As shown in FIG. 33, the supporting member 203 is secured to the plasterboard 40 by using the fixing device shown in FIG. 5, for example. In FIG. 33, the cap 50 is applied on the body 10. In the case as shown in FIG. 33 wherein the supporting member 203 is secured to the vertical wall, the bent-back portion 207 is positioned so as to extend upwardly so that the bent portion 206 between the base portion 205 and the bent-back portion 207 serves as a hook for hanging an article therefrom. In this case, it is preferred to locate the bent portion 208 at a position on or adjacent to the central axis of the fixing device. When the supporting member 203 is secured to the ceiling, the bent portion 208 serves a hook for hanging an article.

The supporting member 203 described above is very useful, because it can be firmly secured to the vertical wall or the ceiling by means of the fixing device of the present invention.

Figure 34:
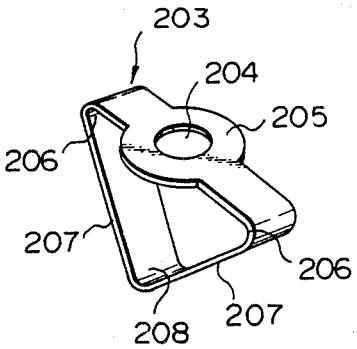
FIGS. 34 to 41, inclusive, are views showing various alternative embodiments of the supporting member shown in FIG. 32.

FIGS. 34–41 show various modifications of the supporting member 203 serving as a hook. FIG. 34 shows a supporting member 203 similar to that shown in FIG. 33 but in the closed triangular form.

Figure 35:
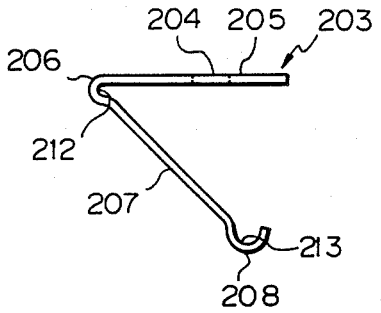
Figure 36:
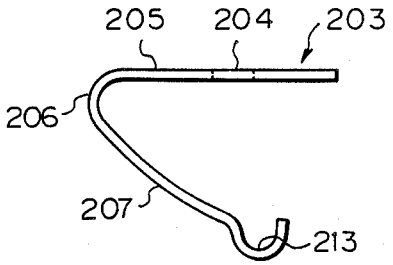
Figure 37:
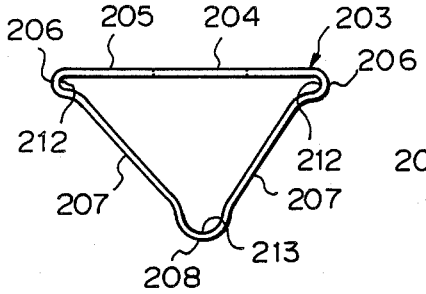
Figure 38:
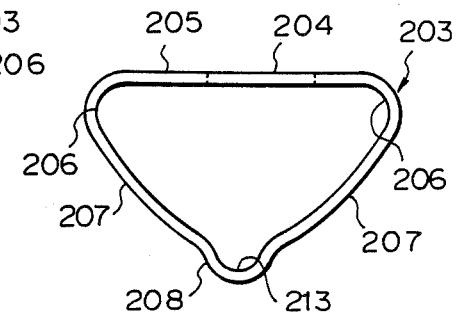
Figure 39:
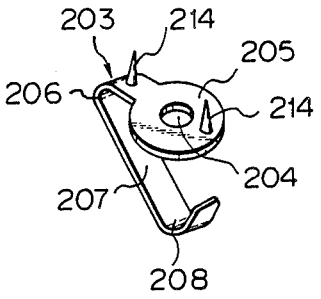
Figure 40:
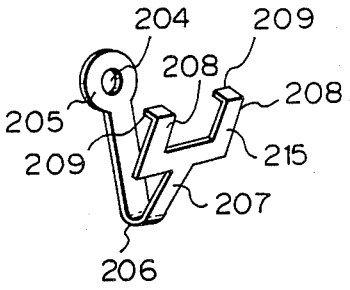
Figure 41:
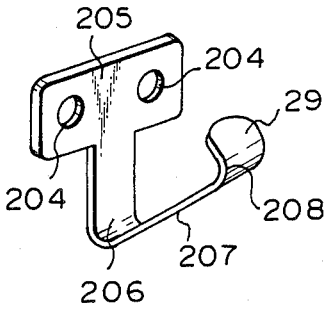

FIG. 35 shows a supporting member 203 wherein each of the bent portion 206, 208 is made in an arcuately rounded form so as to constitute latching portions 212, 213, respectively. FIG. 36 shows a supporting member 203 wherein the bent-back portion 207 is made in a curved form while a latching portion 213 having a large radius of curvature is provided at the tip of the bent-back portion 207. FIGS. 37 and 38 show supporting members wherein rounded portions such as 212, 213 shown in FIGS. 35 and 36 are applied to the supporting member 203 shown in FIG. 34, respectively. FIG. 39 shows an embodiment wherein temporarily fixing pins 214 similar to those described previously are secured to the base portion 205 shown in FIG. 32. It is further possible to form bifurcated arms 215 in the tip of the bent-back portion 207 as shown in FIG. 40, or to form a plurality of openings 204 in the base portion 205 each for receiving a fixing member.

Figure 42:
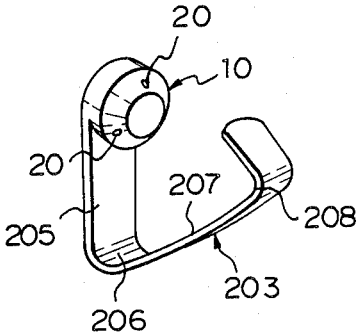
FIG. 42 is a perspective view showing an embodiment of the fixing device of the present invention wherein a supporting member is integrally formed in the fixing device.

FIG. 42 shows an embodiment of the fixing device wherein the supporting member 203 is integrally formed with the body member 11 of the fixing device. As described above, the fixing device of the present invention can not only be made in the form for use solely by itself or for use together with a separate supporting member, but also it can be integrally formed with a supporting member which can be made optionally in any configuration without being limited to the embodiments shown in the drawings.

Figure 43:
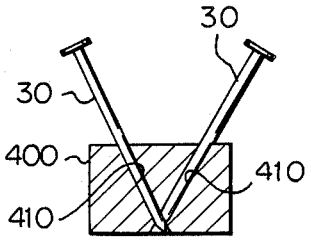
FIG. 43 is a cross-sectional view showing the state of the body wherein fixing members such as nails or set screws are temporarily secured to the body in position for facilitating the fixing operation.

FIG. 43 shows an embodiment of the fixing device of the present invention wherein a body 400 in the simple cylindrical form is provided with a plurality of guide holes 410 in like manner as described previously in each of which a part of each fixing member such as a nail 30 or a set screw is inserted and temporarily secured in this position by means such as a bonding agent. This embodiment greatly facilitates the final fixing operation of the fixing device, because it is not necessary to insert the fixing members into the respective guide holes, while an opportunity of losing the fixing members is completely avoided.

Figure 44:
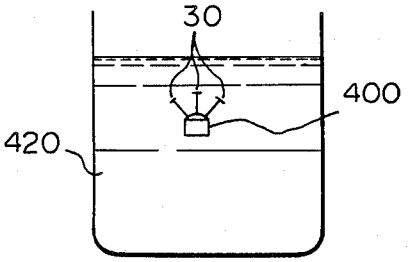
FIG. 44 is a view showing a method for temporarily securing the fixing members in the body.
Figure 45:
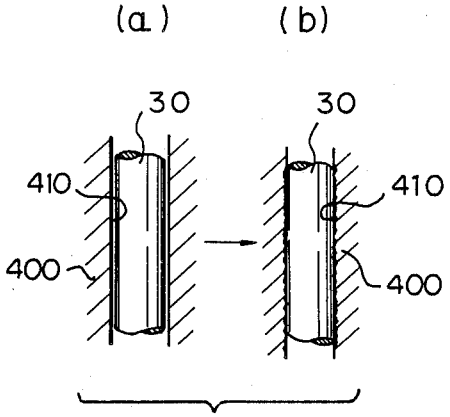
FIG. 45 is a view showing the state of the fixing member temporarily secured to the body using the method shown in FIG. 44.

As a method of temporarily securing the fixing members 30 in the respective guide holes 410, there is proposed a method as shown in FIG. 44. In this method, the body 400 is made of ABS resin and the fixing members 30 are made of stainless steel, and the body 400 having the fixing members 30 partly inserted into the respective guide holes 410 in the body 400 is immersed into the solution of methyl ethyl ketone (M.E.K.) 420 for 1–2 seconds as shown in FIG. 44 and then removed therefrom so as to be dried by air. In this method, the solution of methyl ethyl ketone enters the annular space between the inner peripheral surface of each guide hole 410 and the outer peripheral surface of each fixing member 30 as shown in FIG. 45(*a*), and the ABS resin of the inner surface of the guide hole 410 is softened to adhere to the fixing member 30 and temporarily secure the same as shown in FIG. 45(*b*), while the outer surface of the body 400 will not be subjected to any defective effect or deformation. As an alternative method of temporarily fixing the fixing members 30, a bonding agent such as a starch having a relatively weak securing force may be used for temporarily securing the fixing members 30 to the guide holes 410.

Figure 46:
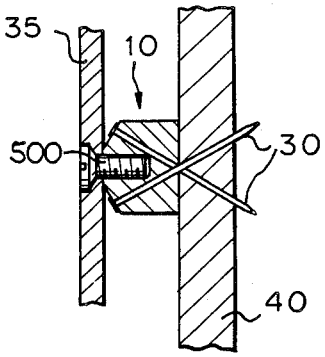
FIG. 46 is a sectional view showing the state of an article attached to the body of the fixing device of the present invention by using a set bolt.
Figure 47:
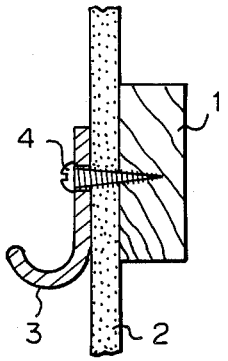
Fig. 47 PRIOR ART
FIGS. 47 to 49 are cross-sectional views showing the prior art fixing devices, respectively.
Figure 48:
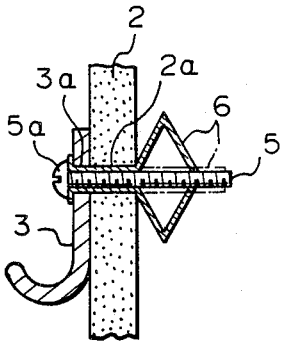
Fig. 48 PRIOR ART
Figure 49:
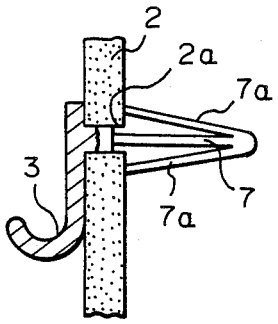
Fig. 49 PRIOR ART

Finally, FIG. 46 shows an alternative embodiment of the fixing device of the present invention. In this embodiment a threaded hole 500 is formed in the head of the body 10 secured to the plasterboard 40 by using the fixing members 30 as described previously, and the article 35 is secured to the head of the body 10 by means of a set bolt threaded into the threaded hole 500.

As described above, the fixing device of the present invention can be positively and easily secured in the stable manner to a brittle board such as a plasterboard, a refractory board, or a veneer plywood with a great securing force by using nails or set screws. Such a firm securing force can be achieved in any direction around the normal to the plane of the surface to which the fixing device is secured, while a large resistive force against removal of the fixing members is obtained. Thus, the fixing device of the present invention can be used for any brittle wall or ceiling oriented in any direction.

Since the fixing device of the present invention is simple in construction and easy in securing operation, it is conveniently used in home use.

As described above, the fixing device can be used solely by itself for a brittle wall or ceiling or used together with a supporting member such as a hook or can be integrally formed with a supporting member, and it is easy to remove the fixing device without leaving any unsightly holes or flaws in the wall from which it is removed, thus affording a superior advantage as a fixing device.

What is claimed is:

1. Fixing device comprising:

(a) a body adapted to be secured directly onto a brittle wall portion or secured to said brittle wall portion with a member to be attached to said wall portion interposed between said body and said wall portion, said body being formed with at least two guide holes passing therethrough from the top to the bottom thereof each for receiving therein a fixing member such as a set screw or a nail so that, in use, it is extended into said wall portion to thereby fixedly secure said body to said wall portion, each of said guide holes being oriented in such an inclined direction with respect to the normal to said wall portion that said fixing members do not intersect with each other and such that some of said fixing members do not extend in parallel to the remaining fixing members; and (b) an engageable member adapted to be detachably engaged with said body over the same, said engageable member having formed integrally therewith a supporting portion such as a hook or a hanger, wherein:

(c) said body is cylindrical in shape and said guide holes form a plurality of pairs with ones extending in parallel to each other at an angle with respect to the normal to said wall portion while the others extend in parallel to each other at said angle with respect to the normal to said wall portion but in the direction opposite to the direction of said ones of said guide holes;

(d) said body is formed at its outer periphery with a threaded portion; and (e) said engageable member has an inner space for receiving said body and is formed with a mating threaded portion for engaging with said threaded portion of said body so as to detachably mount said engageable member on said body.

2. Fixing device comprising:

(a) a body adapted to be secured directly onto a brittle wall portion or secured to said brittle wall portion with a member to be attached to said wall portion interposed between said body and said wall portion, said body being formed with at least two guide holes passing therethrough from the top to the bottom thereof each for receiving therein a fixing member such as a set screw or a nail so that, in use, it is extended into said wall portion to thereby fixedly secure said body to said wall portion, each of said guide holes being oriented in such an inclined direction with respect to the normal to said wall portion that said fixing members do not intersect with each other and such that some of said fixing members do not extend in parallel to the remaining fixing members; and (b) an engageable member adapted to be detachably engaged with said body over the same, said engageable member having formed integrally therewith a supporting portion such as a hook or a hanger, wherein:

(c) said body is cylindrical in shape and said guide holes form a plurality of pairs, said guide holes in each pair extending at an angle to the normal to said wall portion in parallel but in the opposite direction to each other;

(d) said pairs of guide holes are arranged in angular symmetry around the central axis of said body;

(e) said body is formed in its outer periphery with engaging means such as projections and L-shaped grooves each having an arm perpendicular to the direction of said central axis; and (f) said engageable member has an inner space for receiving said body and is formed with mating engaging means for engaging with said engaging means in said body so as to detachably mount said engageable member on said body.

3. Fixing device comprising a body adapted to be secured directly onto a brittle wall or adapted to be secured to said wall with another member interposed between said body and said wall, said body having a central axis and at least three guide holes formed therein, said guide holes being arranged at at least substantially equal angular spacing from each other around said central axis of said body, the opening of each one of said guide holes at the top of said body being located at a position remote from said central axis, while the opening at the bottom of each one of said guide holes is located at a position adjacent to said central axis, said guide holes being oriented in angular symmetry around said central axis of said body to each other with each guide hole approaching nearer said central axis from the upper end to the lower end thereof but not intersect each other even at the extension thereof, while the rotational phase at portions of each guide hole being shifted symmetrically around said central axis relative to each other from the upper end to the lower end thereof so that, in use, fixing members such as nails and set screws inserted into corresponding guide holes and driven into said wall to secure said body onto said wall do not intersect with each other and do not extend in parallel to each other.

4. Fixing device according to claim 3 wherein:

(a) the top of said body is in the form of a frustrum and (b) said openings of said guide holes at the top of said body are located in the conical surface of said frustrum.

5. Fixing device comprising a body adapted to be secured directly onto a brittle wall or adapted to be secured to said wall with another member interposed between said body and said wall, said body having a central axis and at least three guide holes formed therein, said guide holes being arranged at at least substantially equal angular spacing from each other around said central axis of said body, the opening of each one of said guide holes at the top of said body being located at a position remote from said central axis, while the opening at the bottom of each one of said guide holes is located at a position adjacent to said central axis, said guide holes being arranged so as not to intersect with said central axis, said opening at the top and said opening at the bottom of each guide hole being angularly shifted relative to each other around said central axis so that, in use, fixing members such as nails or set screws inserted into corresponding guide holes and driven into said wall to secure said body onto said wall do not intersect with each other and do not extend in parallel to each other, wherein:

(a) a stepped cylindrical portion or a portion in the shape of a frustrum is formed at the bottom portion of said body and (b) said stepped cylindrical portion or said portion in the shape of a frustrum is adapted to engage with an opening formed in said interposed member.

6. Fixing device according to claim 3 wherein at least one pin is provided at the bottom of said body extending outwardly therefrom for the purpose of temporarily fixing said body.

7. Fixing device according to claim 3 wherein at least one through-hole extending from the top to the bottom of said body is formed in said body at least substantially parallel to said central axis for receiving therein and passing therethrough a temporary fixing pin.

8. Fixing device according to claim 3 wherein a threaded portion is formed inside each of said guide holes for threadedly engaging with a thread formed on a set screw adapted to be inserted therein.

9. Fixing device according to claim 3 wherein each one of said fixing members is temporarily secured in the corresponding guide hole in such a manner that said fixing members can be driven into said wall for fixing said body on said wall when said body is placed in position on said wall.

10. Fixing device according to claim 3 wherein said body is integrally formed with supporting means such as a hook or a hanger.

11. Fixing device according to claim 3 wherein said body is cylindrical in shape.

12. Fixing device comprising a body adapted to be secured directly onto a brittle wall and an engaging member which engages with said body, said body being formed with at least two pairs of guide holes passing therethrough from the top to the bottom thereof each for receiving therein a fixing member such as a set screw or a nail so that, in use, said fixing member is driven into said wall to thereby firmly secure said body to said wall, said body having a pair of parallel side surfaces, each one of said guide holes in each pair being located adjacent to a corresponding one of said pair of parallel side surfaces, one of said guide holes in each pair being inclined at an angle with respect to the normal to said wall in parallel to one of said side surfaces, while the other guide hole in each pair is located along the other side surface and is inclined at said angle with respect to the normal to said wall in the direction opposite to the direction of the inclination of said one of said guide holes in parallel to said other side surface, the projection of said guide holes in each pair onto a plane parallel to said side surfaces intersecting each other at a position adjacent to the bottom of said body, said pair of side surfaces being formed with engaging means such as projections and grooves, said engaging member being formed in its inner side walls with mating engaging means for slidably engaging with said engaging means formed in said side surfaces of said body.

13. Fixing device comprising a body adapted to be secured directly onto a brittle wall and an engaging member which engages with said body, said body being formed with guide holes passing therethrough from the top to the bottom thereof each for receiving therein a fixing member such as a set screw or a nail so that, in use, said fixing member is driven into said wall to thereby firmly secure said body to said wall, said body being of a cylindrical shape, said guide holes forming a plurality of pairs, one of said guide holes in each pair extending at an angle to the normal to said wall, while the other guide hole in each pair extends at said angle to the normal to said wall but in the opposite direction to said one of said guide holes in each pair, the planes perpendicular to said wall and including said guide holes in each pair, respectively, being in parallel to each other, said guide holes in each pair coming closest to each other at positions near the bottom of said body, said pairs of guide holes being arranged around said central axis of said body at an equal angular spacing to each other with respect to said central axis, said body being formed in its periphery with engaging means adapted to engage with said engaging means having in the inner space an engageable member adapted to receive therein said body, thereby permitting said engageable member to be detachably mounted on said body.

14. Fixing device according to claim 13 wherein both of said engaging means comprise threaded portions threadedly engaging with each other.

15. Fixing device according to claim 13 wherein one of said two engaging means comprises a plurality of projections and the other one of said two engaging means comprises a plurality of L-shaped grooves each one of which is adapted to engage with a corresponding one of said plurality of projections, each one of said plurality of L-shaped grooves comprising a lateral groove extending perpendicularly with respect to the direction of said central axis.

* * * * *